US010533422B2

(12) United States Patent
Jung

(10) Patent No.: US 10,533,422 B2
(45) Date of Patent: Jan. 14, 2020

(54) GAS TURBINE DISK

(71) Applicant: DOOSAN HEAVY INDUSTRIES & CONSTRUCTION CO., LTD., Gyeongsangnam-do (KR)

(72) Inventor: Sungchul Jung, Daejeon (KR)

(73) Assignee: Doosan Heavy Industries Construction Co., Ltd, Gyeongsangnam-do (KR)

( * ) Notice: Subject to any disclaimer, the term of this patent is extended or adjusted under 35 U.S.C. 154(b) by 758 days.

(21) Appl. No.: 15/225,563

(22) Filed: Aug. 1, 2016

(65) Prior Publication Data

US 2017/0096898 A1 Apr. 6, 2017

(30) Foreign Application Priority Data

Oct. 2, 2015 (KR) ..... 10-2015-0139135

(51) Int. Cl.
*F01D 5/02* (2006.01)
*F01D 5/06* (2006.01)
*F01D 5/08* (2006.01)

(52) U.S. Cl.
CPC ..... *F01D 5/08* (2013.01); *F01D 5/02* (2013.01); *F01D 5/026* (2013.01); *F01D 5/06* (2013.01);

(Continued)

(58) Field of Classification Search
CPC ... F01D 5/02; F01D 5/026; F01D 5/06; F01D 5/066; F01D 5/08; F05D 2220/31; F05D 2220/32; F05D 2240/24
See application file for complete search history.

(56) References Cited

U.S. PATENT DOCUMENTS 2,650,017 A * 8/1953 Pedersen ..... F01D 5/066 416/201 R
6,053,701 A * 4/2000 Ichiryu ..... F01D 5/084 415/115

(Continued)

FOREIGN PATENT DOCUMENTS

EP 0341455 A2 11/1989
JP 09137701 A * 5/1997

(Continued)

OTHER PUBLICATIONS

An extended European Search Report dated Feb. 3, 2017 issued by the EPO in connection with the European Application No. 16181480.1.

(Continued)

*Primary Examiner* — Woody A Lee, Jr.
*Assistant Examiner* — Christopher R Legendre
(74) *Attorney, Agent, or Firm* — Invenstone Patent, LLC

(57) ABSTRACT

A gas turbine disk includes a rotor and a tie-bolt. The rotor includes a plurality of blades and a plurality of disks. The plurality of blades are disposed on outer circumferential surfaces of the plurality of disks. The tie-bolt is disposed along a center axis of the rotor and through a bore defined through hollow portions of the plurality of disks, so as to couple the plurality of disks to each other. A diameter of the bore is larger than a diameter of the tie-bolt. The plurality of disks respectively include a groove spaced from the bore in the circumferential direction of the bore, the groove being elongated in the axial direction of the bore such that cooling air flows through an internal space thereof.

18 Claims, 7 Drawing Sheets

(52) U.S. Cl.
CPC ..... *F01D 5/066* (2013.01); *F05D 2220/32* (2013.01); *F05D 2240/24* (2013.01); *F05D 2250/11* (2013.01); *F05D 2250/12* (2013.01); *F05D 2250/141* (2013.01); *F05D 2260/20* (2013.01); *F05D 2260/30* (2013.01); *F05D 2260/941* (2013.01)

(56) References Cited

U.S. PATENT DOCUMENTS

| | | | | |
|---|---|---|---|---|
| 6,095,751 | A * | 8/2000 | Hirokawa | F01D 5/066 415/114 |
| 2010/0143149 | A1 | 6/2010 | Benkler et al. | |
| 2013/0280028 | A1 | 10/2013 | Benjamin et al. | |
| 2015/0240644 | A1 | 8/2015 | Ross et al. | |
| 2017/0096898 | A1* | 4/2017 | Jung | F01D 5/02 |
| 2018/0051710 | A1* | 2/2018 | Takamura | F02C 7/18 |
| 2019/0072037 | A1* | 3/2019 | Oya | F04D 19/02 |

FOREIGN PATENT DOCUMENTS

| | | | |
|---|---|---|---|
| JP | 10-131767 | A | 5/1998 |
| JP | 2005048771 | A | 2/2005 |
| JP | 2010520968 | A | 6/2010 |
| KR | 1020100102211 | B1 | 10/2013 |
| KR | 101509382 | B1 | 4/2015 |

OTHER PUBLICATIONS

Notice of Allowance issued in corresponding Korean Application No. 10-2015-0139135, dated Oct. 31, 2016, 1 page.

* cited by examiner

Related Art

GAS TURBINE DISK

CROSS-REFERENCE TO RELATED APPLICATIONS

This application claims priority to Korean Application No. 10-2015-0139135, filed Oct. 2, 2015, the contents of which are incorporated herein in their entirety.

BACKGROUND

The present disclosure relates to a disk of a gas turbine and, more particularly, to a structure of a bore part of a gas turbine, in which a groove is formed on the bore part.

In general, a gas turbine is a kind of an internal combustion engine for converting heat energy into mechanical energy while expanding the combustion gas of high temperature and high pressure, produced by an air-fuel mixture after mixing fuel with air compressed under high pressure in a compressor, wherein the compressor and a rotor obtain rotation force from rotor parts.

FIG. 1 shows a related art gas turbine disk and a tie-bolt.

Referring to FIG. 1, in order to form such a compressor rotor part 2 and a turbine rotor part 3, a plurality of compressor rotor disks 21, on which outer circumferential surfaces a plurality of compressor blades 22 are disposed, are connected to each other so as to rotate integrally and, in the same way, a plurality of turbine rotor disks 31, on which outer circumferential surfaces a plurality of turbine blades 32 are disposed, are connected to each other so as to rotate integrally, wherein the compressor rotor disks 21 and the turbine rotor disks 31 are coupled using a tie-bolt 5, which extends penetrating the center parts of the compressor rotor disks 21 and the turbine rotor disks 31.

Herein, the hollow part of the disks 21, which is penetrated by the tie-bolt, is to be a bore part 7, wherein the bore part 7 is applied with maximum stress according to rotational motion. In order to reduce the stress of the bore part 7, a bore radius is reduced. However, there is a limitation on the minimum radius of the bore part 7 because a minimum cooling air path has to be secured. Therefore, there is a problem that the bore part 7 has to be changed in shape at positions, to which maximum stress is applied, so as to reduce the maximum stress while securing a cooling path.

BRIEF SUMMARY

Accordingly, the present disclosure has been made to address the above-mentioned problems occurring in the related art. In order to overcome the conventional limitation on a minimum radius of a bore part so as to secure a minimum cooling air path while reducing the radius of the bore part so as to reduce the stress applied to the bore part, it is an objective of the present disclosure to provide a gas turbine disk, in which the radius of a bore part of a gas turbine is reduced and simultaneously a groove is provided to the bore part such that it possible to reduce the stress as well as secure a cooling channel.

To accomplish the above objective, according to an embodiment of the present disclosure, it is conceivable to provide a gas turbine disk, comprising: a rotor part including a plurality of blades and a plurality of disks, on which outer circumferential surfaces the plurality of blades are arranged; and a tie-bolt arranged along the center axis of the rotor part, penetrating a bore part that is a hollow part of the plurality of disks, so as to couple the plurality of disks to each other, wherein the diameter of the bore part is larger than the diameter of the tie-bolt, and the bore part has a groove path formed of a groove which is formed to be spaced from the bore part in the circumferential direction of the bore part and elongated in the axial direction of the bore part such that cooling air can flow through the internal space thereof.

According to an embodiment of the present disclosure, it is conceivable that the groove path is formed of a groove in a semi-circular shape.

According to another embodiment of the present disclosure, it is conceivable that the groove path is formed of a groove in any one shape of a circle, a triangle, a rectangle and a polygon.

According to still another embodiment of the present disclosure, it is conceivable that the gas turbine disk comprises a ring-shaped support member disposed on the groove path so as to support the tie-bolt with respect to a cooling air pipe.

It is conceivable that the ring-shaped support member includes: an inner ring disposed in close contact with the outer circumferential surface of the tie-bolt; an outer ring disposed in close contact with the bore part; and a plurality of support arms, each of which one end is connected to the inner ring and the other end is connected to the outer ring so as to support the inner ring and the outer ring with respect to each other.

According to an embodiment of the present disclosure, it is conceivable that the outer ring is fixed at a position protruding from the bore part towards the center part of the disks except the groove path.

According to another embodiment of the present disclosure, it is conceivable that the outer ring has an outer circumferential surface coupled to the groove path so as to be shape-matched with the groove path.

Further, according to still another embodiment of the present disclosure, it is conceivable that the outer ring has an inner circumferential surface formed in an annular shape.

According to the present disclosure, it is possible to reduce the radius of the bore part of the gas turbine and simultaneously provide a groove to the bore part, thereby reducing stress while securing a cooling channel.

DETAILED DESCRIPTION

Reference will be now made in detail to the preferred embodiments of the present disclosure with reference to the attached illustrative drawings. It should be noted that, in adding reference signs to the constituent elements in each of the drawings, the same constituent elements have the same reference signs even though they are illustrated in different figures. In addition, in the description of the present invention, when it is judged that detailed descriptions of known functions or structures may make the essential points vague, the detailed descriptions of the known functions or structures will be omitted.

Further, in the description of the constituent elements of the embodiments of the present invention, it is possible to use terms such as first, second, A, B, (a), (b) and the like. These terms are just to distinguish the constituent elements from any other constituent elements but do not limit the essential characteristics or sequence or order and the like of corresponding features by the terms. Additionally, it should be also understood that the expression that some constituent element is "connected", "coupled" or "joined" to another constituent element means that some constituent element may be directly connected or joined to another constituent element or is "connected", "coupled" or "joined" to another constituent element through a further component there between.

Figure 1:
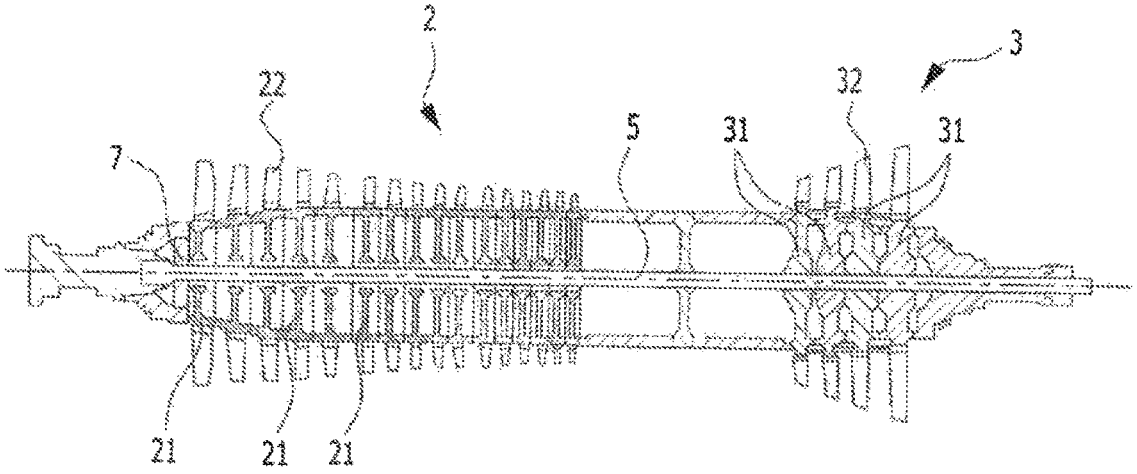
FIG. 1 is a cross-sectional view of a related art gas turbine disk and a tie-bolt.
Figure 2:
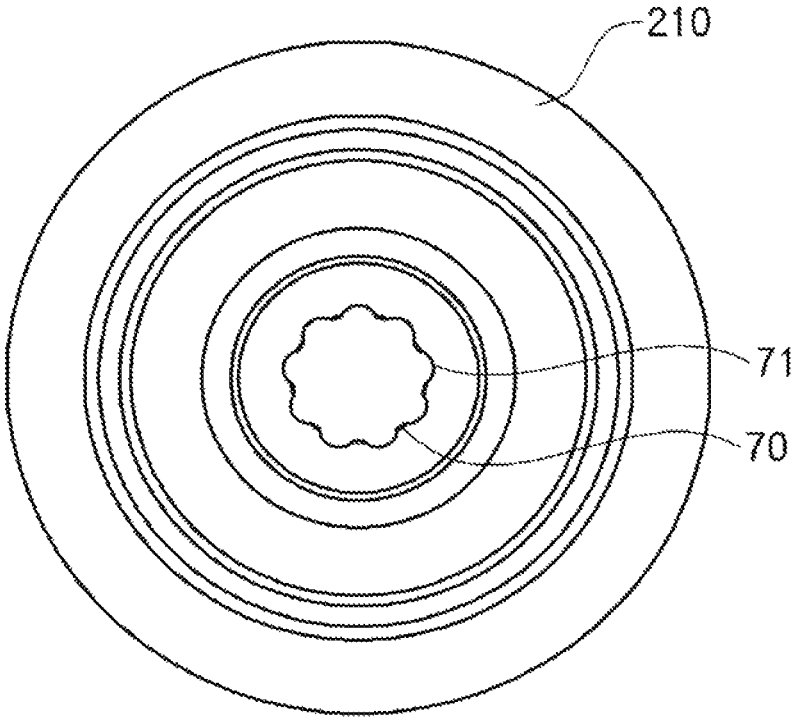
FIG. 2 is a top view of a disk of a gas turbine according to an embodiment of the present disclosure.

FIG. 2 shows a disk of a gas turbine according to an embodiment of the present disclosure.

Figure 3:
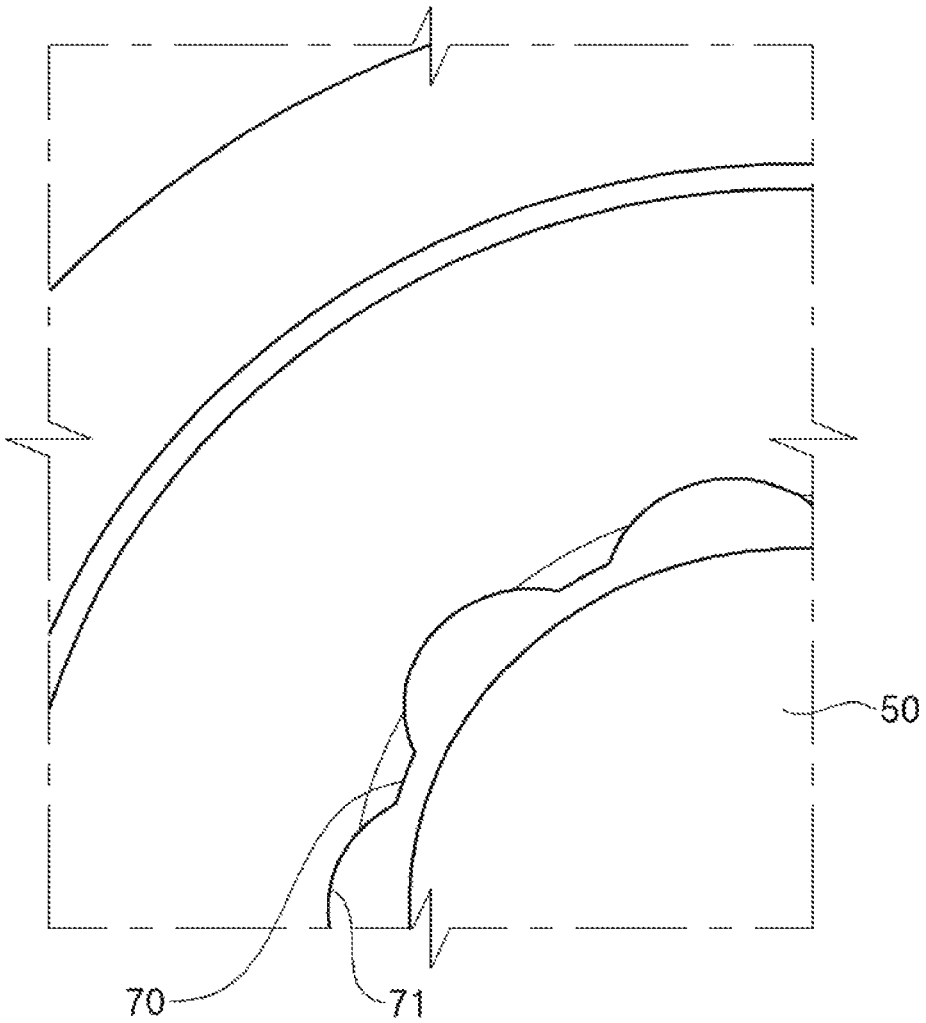
FIG. 3 is an enlarged view of a groove of a bore part forming the disk of the gas turbine according to an embodiment of the present disclosure.

FIG. 3 shows a groove of a bore part forming the disk of the gas turbine according to an embodiment of the present disclosure.

Figure 4:
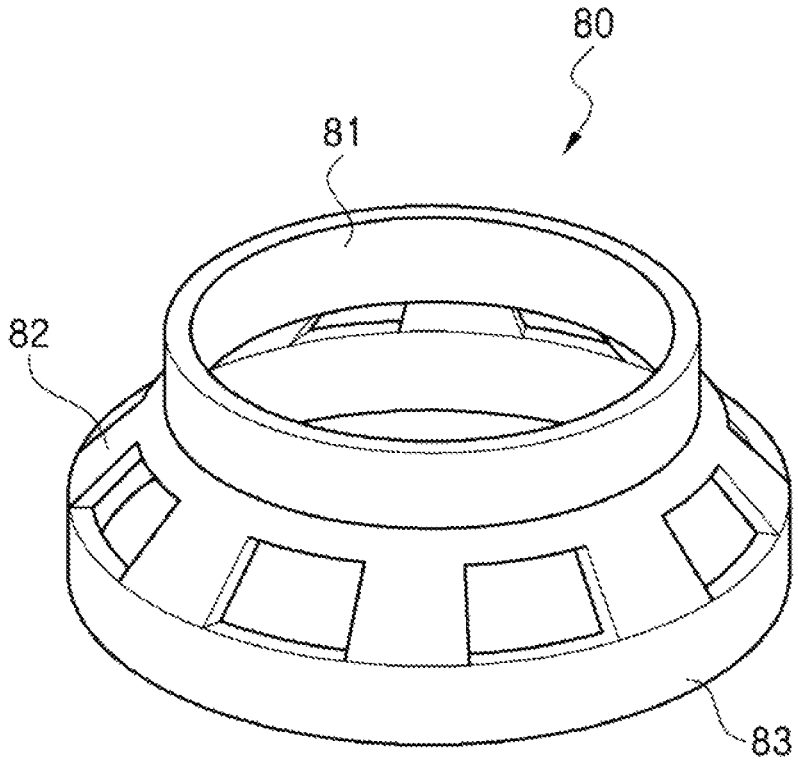
FIG. 4 is a perspective view showing a groove of a bore part forming the disk of the gas turbine according to an embodiment of the present disclosure.

FIG. 4 is a perspective view showing a groove of a bore part forming the disk of the gas turbine according to an embodiment of the present disclosure.

Figure 5:
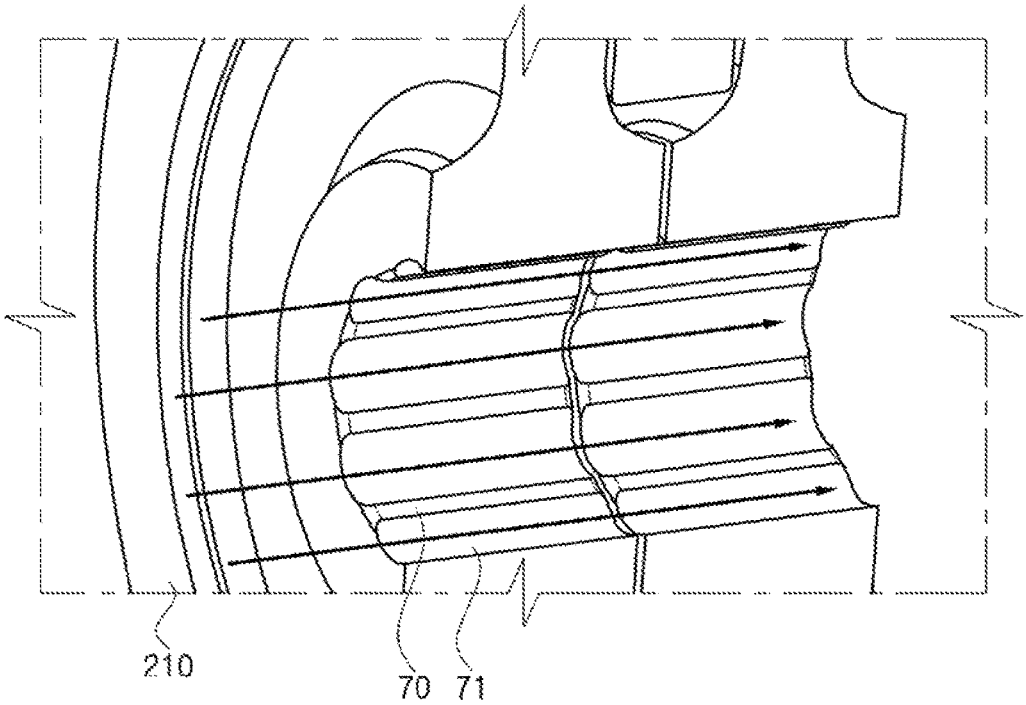
FIG. 5 is an enlarged perspective view of a ring-shaped support member for supporting the disk of the gas turbine and a tie-bolt with respect to each other, according to an embodiment of the present disclosure.

FIG. 5 shows a ring-shaped support member for supporting the disk of the gas turbine and a tie-bolt with respect to each other, according to an embodiment of the present disclosure.

Figure 6:
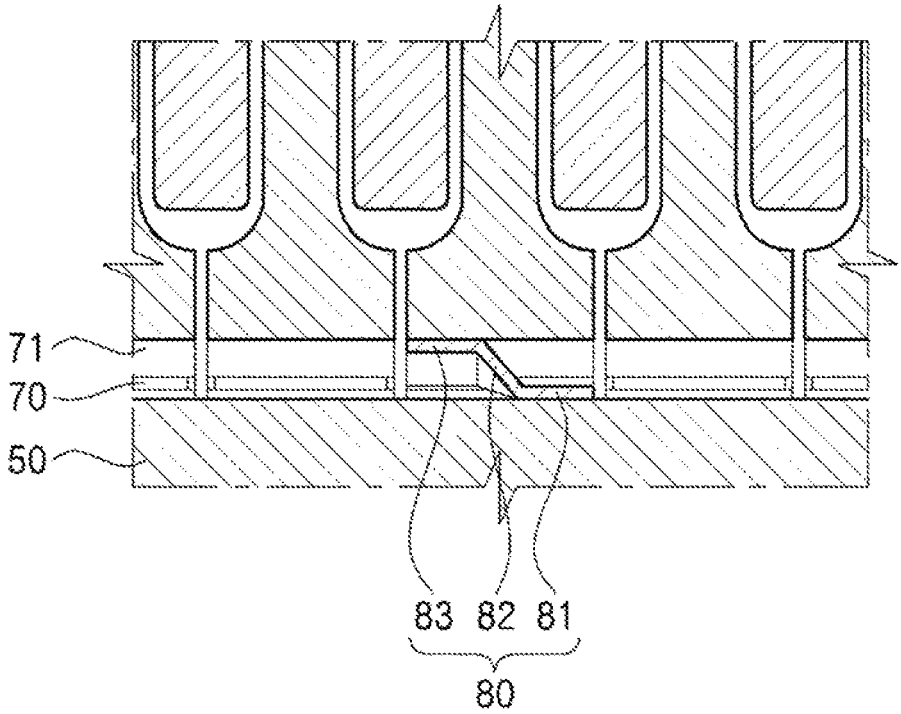
FIG. 6 is a cross-sectional side view of a disk of a gas turbine according to an embodiment of the present disclosure.

FIG. 6 is a side view of a disk of a gas turbine according to an embodiment of the present disclosure.

Figure 7:
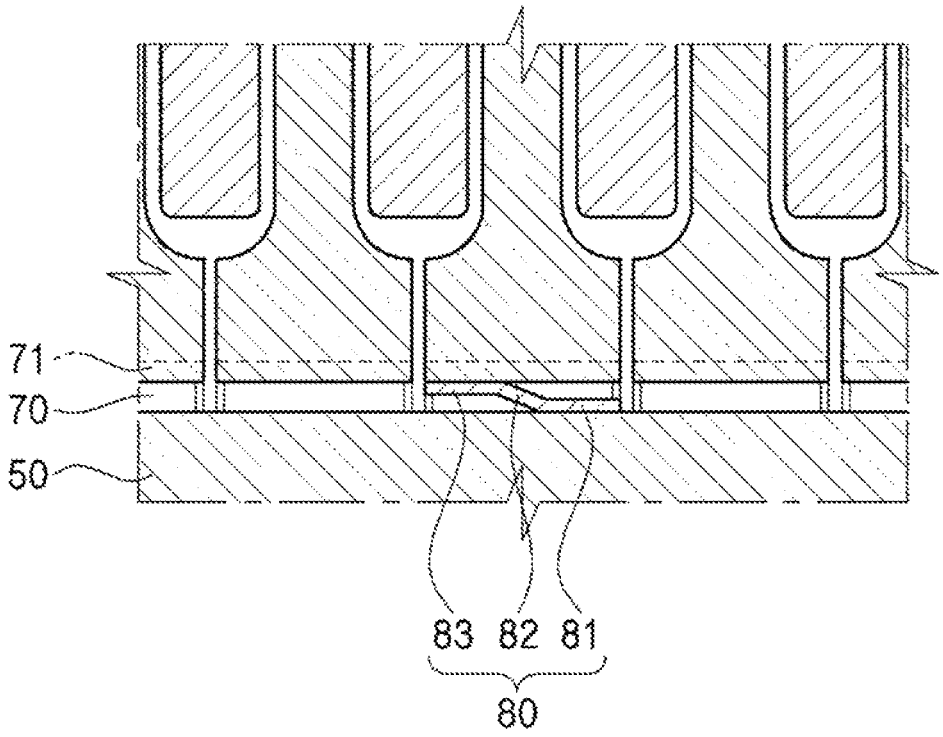
FIG. 7 is a cross-sectional side view showing a disk of a gas turbine according to another embodiment of the present disclosure.

FIG. 7 is a side view showing a disk of a gas turbine according to another embodiment of the present disclosure.

Brief Explanation of Reference Signs

50: tie-bolt
70: bore part
71: groove path
80: ring-shaped support member
81: inner ring
82: support arms
83: outer ring
200: rotor part
210: disks
220: blades Referring to FIG. 2, a rotor part 2 includes a plurality of blades 22 and a plurality of disks 210, on which outer circumferential surfaces the plurality of blades 22 are arranged, and a tie-bolt 50 arranged along the central axis of the rotor part 2, penetrating a bore part 70 that is a hollow part of the plurality of disks 210, so as to couple the plurality of disks 210 to each other, wherein the diameter of the bore part 70 is larger than the diameter of the tie-bolt 50, and the bore part 70 has a groove path 71 formed of a groove, which is formed to be spaced from the bore part 70 in the circumferential direction of the bore part 70 and elongated in the axial direction of the bore part 70 such that cooling air can flow through the internal space thereof.

There have been many attempts to reduce the radius itself of the bore part 7 so as to reduce the stress applied to the bore part 7 since maximum stress is applied to the bore part 7 according to the rotational motion. However, such a reduction of the radius of the bore part results in the reduction of the cooling air path, decreasing the cooling effect. Therefore, the gas turbine disk according to an embodiment of the present disclosure is provided with the technical features of simultaneously exhibiting the cooling effect and the stress reduction.

According to the above-mentioned features, the bore part 70 is changed in shape at a position, to which maximum stress is applied, so as to reduce the application of the maximum stress while securing a cooling path, wherein it is possible to reduce a bore radius since the groove path 71 can serve as such a cooling path.

As shown in FIG. 3 and FIG. 5, the groove path 71 may be formed of a groove in a semi-circular shape.

In view of this feature, it is possible to reduce the bore radius of the gas turbine simultaneously with reducing the stress as well as securing a cooling channel by the groove path 71 since if is possible to the induce the most stable stress reduction if the groove path 71 is physically formed in the semi-circular shape.

Further, the groove path 71 may be also formed of a groove in any one shape of a circle, a triangle, a rectangle and a polygon.

Meanwhile, as shown in FIG. 4, it is possible to additionally provide a ring-shaped support member 80, which is disposed on the groove path 71 so as to support the tie-bolt 50 with respect to a cooling air pipe.

The ring-shaped support member 80 may include an inner ring 81 disposed in close contact with the outer circumferential surface of the tie-bolt 50, an outer ring 83 disposed in close contact with the bore part 70, and a plurality of support arms 82, each of which one end is connected to the inner ring 81 and the other end is connected to the outer ring 83 so as to support the inner ring and the outer ring with respect to each other.

The support arms 82 and the outer ring 83 may have an impeller shape.

Conventionally, the full length of the gas turbine has been increased according to the tendencies towards the enlargement and the high efficiency of the gas turbine, resulting in a problem that it is not easy to support the rotation of the tie-bolt 50 which rotates at a high speed together with the rotor part 200 of the turbine. In addition, the supporting force is likely to be weakened in the bore part 70 due to the formation of the groove path 71. Therefore, according to an embodiment of the present invention, the tie-bolt 50 and the bore part 70 may be supported with respect to each other by forming the ring-shaped support member 80 and simultaneously an impeller shape may be introduced by providing a gap between the outer ring 83 and the inner ring 81, thereby securing the cooling channel.

That is, the ring-shaped support member 80 has a technical feature, wherein the ring-shaped support member 80 is a damping clamp device so as to serve as a support part (as a support ring) and vibration damping element.

The ring-shaped support member 80 is a structure for supporting the tie-bolt 50 such that the rigidity thereof is increased so as to prevent the natural vibration during the operation of the gas turbine, and may be formed in a shape, in which a notch is provided so as to secure the flow of the cooling air supplied in a compressor turbine direction.

As shown in FIG. 6, the outer ring 83 may be fixed at a position protruding from the bore part towards the center part of the disks except the groove path. That is, the outer ring 83 may be provided to the bore part 70 in a state, where the bore part 70 has a shape, in which no groove path 71 is provided.

In addition, as shown in FIG. 7, the outer ring 83 has an outer circumferential surface coupled to the groove path 71 so as to be shape-matched with the groove path.

In this case, the inner circumferential surface of the outer ring 83 may be formed in an annular shape.

Referring to FIG. 7, the outer ring 83 is matched with the groove path 71 so as to support the disks 210 and the tie-bolt 50 with respect to each other and simultaneously the inner circumferential surface of the outer ring 83 is formed in an annular shape so as to secure the cooling channel as it is.

In view of this feature, the outer ring 83 is fixed and supported at a predetermined position of the groove path 71 or the bore part 70 so as to further improve the stress reduction, which is the objective of the present disclosure.

Hereinabove, even though all of the constituent elements are coupled into one body or operate in a combined state in the description of the above-mentioned embodiments of the present disclosure, the present disclosure is not limited to these embodiments. That is, all of the constituent elements may operate in one or more selective combination within the range of the purpose of the present invention. It should be also understood that the terms of "include", "comprise" or "have" in the specification are "open type" expressions just to say that corresponding constituent elements exit and, unless specifically described to the contrary, do not exclude but may include additional components.

All terms, including technical or scientific terms, unless otherwise defined, have the same meaning as commonly understood by those of ordinary skill in the art, to which the present invention belongs. The terms which are commonly used such as the definitions in the dictionary are to be interpreted to represent the meaning that matches the meaning in the context of the relevant art and, unless otherwise defined explicitly in the present invention, it shall not be interpreted to have an idealistic or excessively formalistic meaning.

The embodiments discussed have been presented by way of example only and not limitation. Thus, the breadth and scope of the invention(s) should not be limited by any of the above-described exemplary embodiments, but should be defined only in accordance with the following claims and their equivalents. Moreover, the above advantages and features are provided in described embodiments, but shall not limit the application of the claims to processes and structures accomplishing any or all of the above advantages.

Additionally, the section headings herein are provided for consistency with the suggestions under 37 CFR 1.77 or otherwise to provide organizational cues. These headings shall not limit or characterize the invention(s) set out in any claims that may issue from this disclosure. Specifically and by way of example, although the headings refer to a "Technical Field," the claims should not be limited by the language chosen under this heading to describe the so-called technical field. Further, a description of a technology in the "Background" is not to be construed as an admission that technology is prior art to any invention(s) in this disclosure. Neither is the "Brief Summary" to be considered as a characterization of the invention(s) set forth in the claims found herein. Furthermore, any reference in this disclosure to "invention" in the singular should not be used to argue that there is only a single point of novelty claimed in this disclosure. Multiple inventions may be set forth according to the limitations of the multiple claims associated with this disclosure, and the claims accordingly define the invention(s), and their equivalents, that are protected thereby. In all instances, the scope of the claims shall be considered on their own merits in light of the specification, but should not be constrained by the headings set forth herein.

What is claimed is:

1. A gas turbine disk assembly, comprising:

a rotor including a plurality of blades and a plurality of disks, the plurality of blades being disposed on outer circumferential surfaces of the plurality of disks; and a tie-bolt disposed along a center axis of the rotor and through a bore defined through hollow portions of the plurality of disks, so as to couple the plurality of disks to each other, wherein a diameter of each bore is larger than a diameter of the tie-bolt, and the plurality of disks respectively include a groove extending from the respective bore in the circumferential direction of the bore, each groove being elongated in the axial direction of the respective bore such that cooling air flows through an internal space thereof, wherein the tie-bolt has a center axis that is disposed so as to coincide with the center axis of the rotor, and the hollow portions are concentric with respect to the center axis of the rotor.

2. The gas turbine disk assembly according to claim 1, wherein each groove is formed in a semi-circular shape.

3. The gas turbine disk assembly according to claim 1, further comprising a ring-shaped support member disposed adjacent the groove of at least one of the plurality of disks so as to support the tie-bolt.

4. The gas turbine disk assembly according to claim 3, wherein the ring-shaped support member includes:

an inner ring disposed in contact with an outer circumferential surface of the tie-bolt; and an outer ring disposed in contact with the at least one of the plurality of disks.

5. The gas turbine disk assembly according to claim 4, wherein the outer ring is fixed to the at least one of the plurality of disks.

6. The gas turbine disk assembly according to claim 5, wherein the outer ring is not fixed to the groove of the at least one of the plurality of disks.

7. The gas turbine disk assembly according to claim 4, wherein the outer ring has an outer circumferential surface having a shape corresponding to a shape of the groove of the at least one of the plurality of disks.

8. The gas turbine disk assembly according to claim 7, wherein the shape of the outer circumferential surface is the same as the shape of the groove of the at least one of the plurality of disks.

9. The gas turbine disk assembly according to claim 7, wherein the outer ring has an inner circumferential surface formed in an annular shape.

10. The gas turbine disk assembly according to claim 4, wherein the ring-shaped support member further includes a plurality of support arms, and wherein each support arm includes a first end connected to the inner ring and a second end connected to the outer ring so as to support the inner ring and the outer ring with respect to each other.

11. The gas turbine disk assembly according to claim 1, wherein for each of the plurality of disks: the groove is one of a plurality of grooves arranged around an outer circumferential surface of the tie-bolt.

12. A gas turbine disk assembly, comprising:

a tie-bolt;

a rotor including a plurality of blades and a plurality of disks, the plurality of blades being disposed on outer circumferential surfaces of the plurality of disks, each of the plurality of disks having a bore through which the tie-bolt is passed in order to couple the plurality of disks to each other, the bores of the respective disks aligned in an axial direction of the rotor to define a hollow part of the rotor; and a ring-shaped support member that is disposed between the tie-bolt and at least one of the plurality of disks and includes:

an inner ring disposed in contact with an outer circumferential surface of the tie-bolt;

an outer ring disposed in contact with the at least one of the plurality of disks, wherein each bore has a diameter larger than a diameter of the tie-bolt, and wherein each of the plurality of disks is formed with a groove extending outward radially from the diameter of the respective bore to create a groove path extending in the axial direction and communicating with the hollow part so that cooling air flows in contact with a surface of each of the plurality of disks.

13. The gas turbine disk assembly according to claim 12, wherein the tie-bolt is disposed so as to coincide with a center axis of the rotor, and the hollow part of the rotor is concentric with respect to the center axis of the rotor.

14. The gas turbine disk assembly according to claim 12, wherein the ring-shaped support member further includes a plurality of support arms, each support arm of the plurality of support arms including a first end connected to the inner ring and a second end connected to the outer ring, and wherein the cooling air flowing in the groove of the at least one of the plurality of disks path flows between adjacent support arms of the plurality of support arms.

15. The gas turbine disk assembly according to claim 12, wherein the outer ring has an outer circumferential surface fitted in the groove of the at least one of the plurality of disks.

16. The gas turbine disk assembly according to claim 12, wherein the outer ring is fixed to the at least one of the plurality of disks and is not fixed to the groove of the at least one of the plurality of disks.

17. The gas turbine disk assembly according to claim 12, wherein each groove has a shape formed as at least part of a semicircle.

18. The gas turbine disk assembly according to claim 17 wherein for each of the plurality of disks:

the groove is one of a plurality of grooves arranged around the outer circumferential surface of the tie-bolt; and wherein the hollow part of the rotor has an outer circumferential surface in which the plurality of grooves of each of the plurality of disks are spaced apart from each other such that a surface portion of the hollow part circumferentially disposed between adjacent grooves of the plurality of grooves has the diameter of each bore.

* * * * *